United States Patent [19]

Margueratt

[11] 4,203,578

[45] May 20, 1980

[54] DOUBLE FINGERED BUMPER JACK BODY

[75] Inventor: Oatway Margueratt, Orillia, Canada

[73] Assignee: Seeburn Metal Products Limited, Beaverton, Canada

[21] Appl. No.: 966,805

[22] Filed: Dec. 5, 1978

[51] Int. Cl.[2] ..... B66F 1/04

[52] U.S. Cl. ..... 254/109; 254/133 R

[58] Field of Search ..... 254/108–111, 254/133, DIG. 4

[56] References Cited

U.S. PATENT DOCUMENTS

| | | | |
|---|---|---|---|
| 1,014,801 | 1/1912 | Beard | 254/DIG. 4 |
| 2,456,375 | 12/1948 | Cedarholm | 254/133 |
| 2,743,903 | 5/1956 | Lucker | 254/133 |
| 3,099,435 | 7/1963 | Nixon | 254/133 |
| 3,180,618 | 4/1965 | Ulm | 254/109 |

*Primary Examiner*—Robert C. Watson

[57] ABSTRACT

A bumper jack for vehicles is provided having improved stability. This bumper jack includes the usual ratchet bar and load lifting housing mounted on the bar for movement therealong. According to the novel feature, the load lifting housing comprises steel side walls surrounding the ratchet bar, with these side walls at one side of the ratchet bar forming a lower inclined bumper engageable ledge and an upper inclined bumper engageable ledge. At the lower edge of each ledge is an upwardly projecting finger member, with each finger having an upwardly and outwardly sloping edge adjacent a ledge, forming a trough between the finger and the ledge. These fingers are adapted to extend through a pair of vertically aligned slots in a bumper, thereby providing both lateral stability and fore and aft stability when lifting a vehicle.

3 Claims, 4 Drawing Figures

DOUBLE FINGERED BUMPER JACK BODY

BACKGROUND OF THE INVENTION

1. Field of the Invention

This invention relates to lifting jacks and more particularly to bumper jacks used with automobiles and trucks.

2. Summary of the Prior Art

Bumper jacks have been on the market for many years and are typically in the form of a ratchet bar and a load lifting housing mounted on the ratchet bar for movement therealong. This load lifting housing usually includes a generally C-shaped or J-shaped load support generally conforming to the contour of a bumper.

A typical bumper jack of the prior type is described in Lucker, U.S. Pat. No. 2,783,903, issued May 1, 1956. One of the main concerns of the auto industry today is safety and a bumper jack, if used without brakes or transmission restraints or on sloping road shoulders, can be a very unstable and dangerous lifting device. Some modern bumper jacks have a lifting finger that fits into a slot provided in a vehicle bumper. Such finger arrangements are also shown in the above patent in FIGS. 5 and 6.

While these fingers were certainly of some value in preventing the jack from simply slipping away from the bumper under load conditions, the jack still remained rather unsafe in that it continued to have poor stability in the fore and aft directions as well as rather poor lateral stability on sloping surfaces.

It is the object of the present invention to provide a new form of load engaging device for bumper jacks which will provide a high degree of safety in all directions, including when the jack is used on sloping ground.

SUMMARY OF THE INVENTION

This invention relates to a vehicle bumper jack having improved lateral stability. The bumper jack has the usual ratchet bar and load lifting housing mounted on the bar for movement therealong. The load lifting housing comprises steel side walls surrounding the ratchet bar, with these side walls at one side of the ratchet bar forming therebetween a lower bumper engageable ledge and an upper bumper engageable ledge, both ledges sloping downwardly away from the ratchet bar. At the lower edge of each ledge is an upwardly projecting finger member with each finger having an upward and outward sloping upper edge adjacent a ledge, forming a trough between the finger and the ledge. These fingers are adapted to extend through a pair of vertically aligned slots in a bumper with the upper edge of each slot resting in a trough between a finger and ledge, thereby providing both lateral stability and fore and aft stability when lifting a vehicle.

When the weight of a vehicle is resting on the jack, this weight rests on the trough portions effectively locking the jack rigidly to the bumper of the vehicle. This locking of the jack rigidly to the bumper gives greatly increased stability in the fore and aft direction as well as in a lateral direction when the base of the jack is resting on a sloping surface, such as a sloping shoulder of a roadway.

Certain preferred embodiments of the apparatus of this invention are illustrated by the attached drawings in which.

Turning now to the drawings, the jack of the invention includes a base member 10 and this may be a fixed base or a tiltable base such as that described in Clarke, U.S. Pat. No. 3,881,692, issued May 6, 1975. The base includes a central socket 11 into which is fitted a ratchet bar or jack strut 12.

Figure 3:
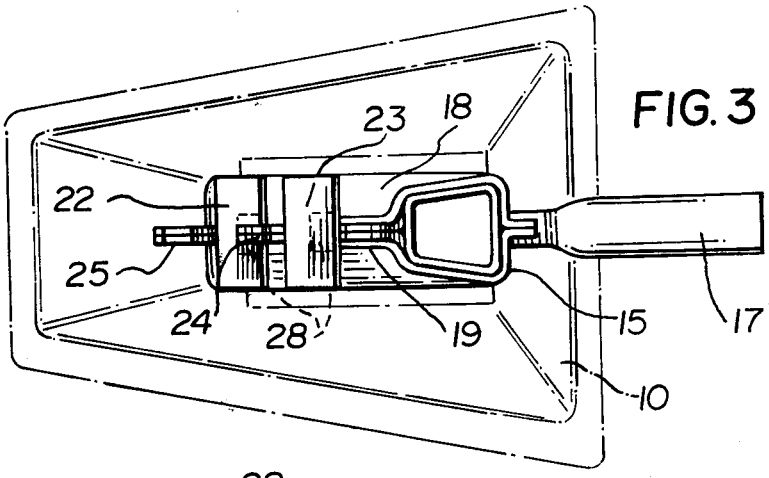
FIG. 3 is a top plan view of the jack in accordance with the invention.

Mounted on the ratchet bar 12 is a load-lifting housing 13 preferably formed from a pair of heavy gauge sheet metal plates 14 which are shaped as will be seen from FIG. 3 to pass around the ratchet bar 12. It includes an upper stabilizer 15 which also raps around the ratchet bar 12 in slidable engagement.

Connected to ends of plates 14 at one side of the ratchet bar are a pair of support plates 16 for the pivotal mounting of an actuating arm 17. This arm 17 actuates a lifting mechanism, the details of which are not illustrated because they are very well known in the art. This mechanism is typically of the type illustrated by U.S. Pat. No. 2,743,903, the content of which is incorporated herein by reference.

Figure 1:
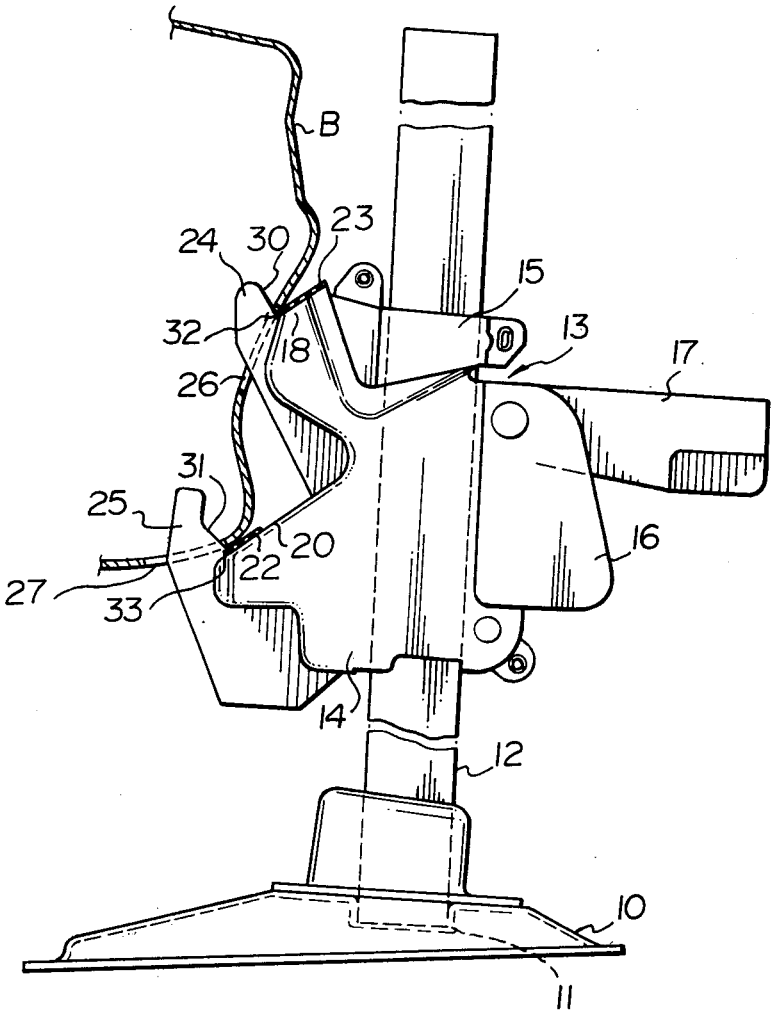
FIG. 1 is a side elevation of a jack in accordance with this invention.
Figure 2:
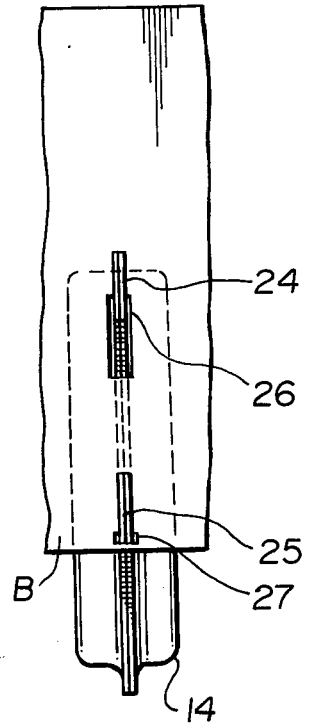
FIG. 2 is an end elevation showing the interior of a bumper with projecting fingers.

The ends of plates 14 remote from actuating arm 17 are cut and shaped in two different manners. Firstly, as can be seen from FIG. 3 certain peripheral edge flanges 18 of plates 14 are bent inwardly toward each other such that the edges 19 are in close proximity thereby creating a substantially flat inclined support ledge. Fixed to this ledge by way of a fastening means is an elastomeric, e.g., rubber pad 23 for engagement with the outer face of bumper B. Adjacent this ledge portion with rubber pad 23 is an upper projecting finger 24 formed by projecting portions of side walls 14 which have been pressed together and welded as shown in FIG. 3. This finger 24 is shaped as shown in FIG. 1 so as to pass through an upper slot 26 in the vehicle bumper B. The finger 24 and the ledge with pad 23 are preferably sloped in the manner shown in FIG. 1 so that the top edge of the slot 26 will rest in the trough 32 formed between the pad 23 and the sloping upper edge 30 of finger 24.

Figure 4:
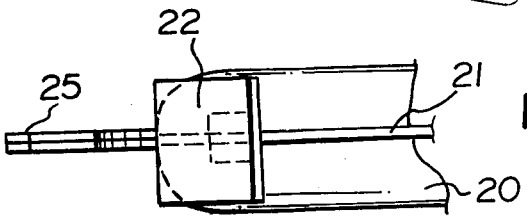
FIG. 4 is a top plan view showing details of a lower projecting finger.

At a lower portion of the load lifting housing, as will be seen from FIG. 4, a further pair of peripheral edge flanges 20 are bent inwardly with their edges 21 in close proximity so as to form a second inclined bumper engageable ledge. A further rubber pad 22 is mounted on this ledge. In the region immediately below this ledge, the plates 14 are again pressed inwardly into contact with each other and welded together to provide a thin projecting finger 25 which projects generally upwardly and is designed to engage a second slot 27 in the bottom edge of a bumper B. This second finger has an inclined upper edge 31 which intersects with the inclined ledge and rubber pad 22 such that the upper edge of slot 27 rests in the trough 33 formed between the inclined portions. The rubber pads 22 and 23 can be mounted by any convenient means, e.g. by bottom tabs into holes 28.

Thus, it will be seen from looking at FIG. 1 that the jack cannot slide in a sideways direction if it should be resting on an inclined surface because the pair of fingers in vertically spaced relationship passing through quite narrow slots prevent any tendency for any sideways turning action as between the jack and the bumper. In other words, it becomes impossible for the jack to move in a sideways direction as long as the vehicle remains in a fixed position.

At the same time, in the fore and aft direction, any turning action of the jack with respect to the bumper is prevented because of the paticular shape and positioning of the fingers and bumper engageable ledges. Thus, as will once again be seen from FIG. 1, the upper edges of the slots 26 and 27 are substantially wedged into the troughs 32 and 33 formed between the inclined pads 22 and 23 and the inclined edge faces 30 and 31 of fingers 24 and 25.

The special design of these inclined ledges and projecting fingers makes it possible to easily insert the fingers into the slots at the start of the lift and also to easily detach the jack from the bumper at the completion of the lift. In other words, the design provides the highly desirable advantages of safety combined with simplicity of use.

The embodiments of the invention in which an exclusive property or privilege is claimed are defined as follows:

1. A bumper jack including a ratchet bar, and a load lifting housing mounted on said bar for movement therealong, said load lifting housing comprising steel side walls surrounding said ratchet bar, with said side walls at one side of said ratchet bar forming therebetween a lower bumper engageable ledge and an upper bumper engageable ledge, said ledges being formed by bending edges of said steel side walls inwardly to form a flat surface sloping downwardly away from the ratchet bar, and said housing also including at the lower edge of each ledge an upwardly projecting finger member with each finger having an upwardly and outwardly sloping upper edge portion adjacent a ledge, forming a trough between the finger and the ledge, said fingers being adapted to extend through a pair of vertically alingned slots in a bumper with the ledges engaging the outer face of the bumper.

2. A bumper jack according to claim 1 wherein each ledge includes an elastomeric pad which engages the outer face of the bumper.

3. A bumper jack according to claim 1 wherein each finger comprises extensions of said side walls pressed together to form a single narrow finger.

* * * * *